US012523009B2

(12) United States Patent
Yamamoto

(10) Patent No.: US 12,523,009 B2
(45) Date of Patent: Jan. 13, 2026

(54) MAINFRAME ROTATION MECHANISM AND ROTATION METHOD FOR EXCAVATION APPARATUS

(71) Applicant: YAMAMOTO FOUNDATION WORKS CO., LTD., Yamanashi (JP)

(72) Inventor: Takekazu Yamamoto, Yamanashi-ken (JP)

(73) Assignee: YAMAMOTO FOUNDATION WORKS CO., LTD., Yamanashi (JP)

( * ) Notice: Subject to any disclaimer, the term of this patent is extended or adjusted under 35 U.S.C. 154(b) by 670 days.

(21) Appl. No.: 17/957,527

(22) Filed: Sep. 30, 2022

(65) Prior Publication Data

US 2024/0035253 A1 Feb. 1, 2024

(30) Foreign Application Priority Data

Aug. 1, 2022 (JP) ..... 2022-122446

(51) Int. Cl.
*E02F 9/10* (2006.01)
*E02F 9/08* (2006.01)

(52) U.S. Cl.
CPC ..... *E02F 9/10* (2013.01); *E02F 9/0841* (2013.01)

(58) Field of Classification Search
CPC ..... E02F 9/10; E02F 9/121; E02F 9/0841
See application file for complete search history.

(56) References Cited

U.S. PATENT DOCUMENTS 1,280,701 A * 10/1918 French ..... E02F 3/08 37/360
1,389,021 A * 8/1921 Vest ..... E21F 13/063 414/744.2
1,511,437 A * 10/1924 Bager et al. ..... E02F 3/96 37/403
1,528,222 A * 3/1925 Miller ..... E02F 3/30 212/253

(Continued)

FOREIGN PATENT DOCUMENTS

CN 111677027 A * 9/2020 ..... E21D 9/122
JP 08-048492 2/1996

(Continued)

OTHER PUBLICATIONS

Yamamoto, T., CN 111677027 A, machine translation. (Year: 2020).*

*Primary Examiner* — Tara Mayo
(74) *Attorney, Agent, or Firm* — Wenderoth, Lind & Ponack, L.L.P.

(57) ABSTRACT

A mainframe rotation mechanism is of an excavation apparatus. The excavation apparatus includes a tubing unit, a base frame, and a mainframe. The base frame is disposed with the tubing unit as a center. The mainframe includes a horizontal frame and a plurality of columns. The horizontal frame includes a slide base for horizontally moving a hammer grab above the tubing unit. The plurality of columns support the horizontal frame above the base frame. The plurality of columns are arranged detachably from the base frame. A casing tube to be arranged in the tubing unit and the horizontal frame are coupled with each other through a rotation assist jig. The casing tube is rotated with the plurality of columns being detached from the base frame. The mainframe is rotated together with the rotation assist jig to a predetermined position.

5 Claims, 13 Drawing Sheets

(56) References Cited

U.S. PATENT DOCUMENTS

| | | | | | |
|---|---|---|---|---|---|
| 1,770,175 | A | * | 7/1930 | Lichtenberg | E02F 9/121 212/170 |
| 3,104,766 | A | * | 9/1963 | Sasadi | B65G 67/00 414/141.1 |

FOREIGN PATENT DOCUMENTS

| | | |
|---|---|---|
| JP | 10-205261 | 8/1998 |
| JP | 10-205263 | 8/1998 |
| JP | 5621026 | 11/2014 |

* cited by examiner

MAINFRAME ROTATION MECHANISM AND ROTATION METHOD FOR EXCAVATION APPARATUS

CROSS-REFERENCE TO RELATED APPLICATIONS

The present application claims priority under 35 U.S.C. § 119 to Japanese Patent Application No. 2022-122446, filed Aug. 1, 2022. The contents of this application are incorporated herein by reference in their entirety.

BACKGROUND

Field

The present application relates to a mainframe rotation mechanism and a rotation method for an excavation apparatus including a mainframe that is rotatable.

Background Art

The description in this section merely provides information of background related to the present disclosure, and may not necessarily constitute the prior art.

In foundation pile construction work at a construction site by use of an excavation apparatus disclosed by JP H10-205261 A and JP H10-205263 A, an all-casing construction method by an excavation machine, which includes a tubing unit for embedding a casing tube into the ground to form a hole wall, and a hammer grab to be lifted down into the hole wall to excavate the ground and to hold and discharge the excavated soil, is used.

In such an all-casing construction method, excavation and transportation are conducted while the hammer grab is suspended by the mainframe from a high position, so a large work space is needed in an overhead space. Hence, there is a drawback that such a construction method cannot be used in a place with a roof or a place with a height limitation such as a tunnel. As a means for improving this, JP H8-48492 A discloses a suspending transportation apparatus in which a mainframe is made to slide horizontally to be capable of transferring a casing tube, H steel, or the like. Such a suspending transportation apparatus, having the mainframe mounted on a self-propelled carriage, is capable of moving to the vicinity of a narrow workplace with a limitation in the overhead space. Then, the operation of sliding and moving rails suspending a drill pipe or the like on a tip end portion in the left-right direction and the operation of embedding the drill pipe or the like into a predetermined excavation place are repeatedly performed.

In addition, JP 5621026 B2 discloses an excavation apparatus that can be carried into and installed in a narrow excavation place with width and height limitations and that can easily conduct excavation work in a low overhead clearance. Also, by rotating and moving soil and the like that have been excavated toward an empty space around the excavation place, the excavation apparatus is capable of changing the direction of soil discharge and facilitating the soil discharge.

In the above-described conventional excavation apparatuses, since a heavy machine such as a crane transports and installs the tubing unit in the excavation place, it is difficult to conduct work in a narrow work space. Further, since a large-sized crane cannot be used in a place with a height limitation, there is a drawback that it is impossible to conduct the excavation up to a sufficient depth.

In the above-described suspending transportation apparatus, the first and second rails corresponding to the conventional rack are arranged horizontally. Thus, in a narrow place with a limitation in the overhead space, by sliding and moving a transported object such as a drill pipe or H steel on the rails, it is possible to transport the object to a predetermined workplace. However, the transportation apparatus of this type is intended to transport the object such as the drill pipe or H steel while suspending the object horizontally. For this reason, the transportation apparatus has a structure of suspending the transported object on a tip end portion of the rail, but due to its structure, the transported object cannot be made to protrude greatly from the main body of the apparatus, and the working range is limited, in some cases. Furthermore, the hammer grab, the casing tube, and the like are heavy in weight, and thus the transportation is not easy by use of only the rails. Moreover, in discharging the soil that has been excavated by the hammer grab from the excavation place, the crane has to be moved by rotation, for example, and the soil discharge operation is also complicated.

With regard to the above-described excavation machine that is rotated to move the excavated soil toward the empty space around the excavation place so as to facilitate the discharge of the excavated soil, the rotation structure of the mainframe that suspends and moves the hammer grab is complicated and the number of component parts is increased. In addition, the rotation mechanism part of the mainframe is constructed on a rotary part of the tubing unit, thereby leading to a possibility that its support becomes unstable.

Therefore, an object of the present application is to provide a mainframe rotation mechanism and a mainframe rotation method for an excavation apparatus capable of rotating a mainframe to a predetermined position above a base unit easily and stably, by use of a tubing unit provided in the base unit, a casing tube, and a rotation assist jig.

SUMMARY

According to one aspect of the present disclosure, a mainframe rotation mechanism is of an excavation apparatus. The excavation apparatus includes a tubing unit, a base frame, and a mainframe. The base frame is disposed with the tubing unit as a center. The mainframe includes a horizontal frame and a plurality of columns. The horizontal frame includes a slide base for horizontally moving a hammer grab above the tubing unit. The plurality of columns support the horizontal frame above the base frame. The plurality of columns are arranged detachably from the base frame. A casing tube to be arranged in the tubing unit and the horizontal frame are coupled with each other through a rotation assist jig. The casing tube is rotated with the plurality of columns being detached from the base frame. The mainframe is rotated together with the rotation assist jig to a predetermined position.

According to another aspect of the present disclosure, a mainframe rotation method is for an excavation apparatus. The excavation apparatus includes a tubing unit, a base frame, and a mainframe. The base frame is disposed with the tubing unit as a center. The mainframe includes a horizontal frame and a plurality of columns. The horizontal frame includes a slide base for horizontally moving a hammer grab above the tubing unit. The plurality of columns support the horizontal frame above the base frame. The mainframe rotation method includes arranging a rotation assist jig between a casing tube to be arranged in the tubing unit and the horizontal frame, coupling the rotation assist jig to the casing tube and the horizontal frame, detaching the plurality of columns from the base frame, driving the tubing unit to rotate so as to rotate the casing tube, and rotating the mainframe together with the rotation assist jig to a predetermined position.

In the mainframe rotation mechanism of the excavation apparatus according to the present disclosure, although the excavation apparatus has a simple configuration of the minimal number of component parts including the tubing unit and the casing tube to be arranged in the tubing unit, which are fundamental component elements of the excavation apparatus, and the rotation assist jig that is a dedicated part, the mechanism enables the mainframe including the horizontal frame and the plurality of columns to rotate to a predetermined position above the base frame. This configuration enables the excavation and the discharge of excavated soil efficiently in accordance with environments such as a height and a space of a work site.

In the mainframe rotation method according to the present disclosure for the excavation apparatus, the use of the rotation assist jig to be coupled between the casing tube to be arranged in the tubing unit and the horizontal frame of the mainframe enables the entire mainframe to rotate to a predetermined position easily and stably.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DESCRIPTION OF THE EMBODIMENTS

Figure 1:
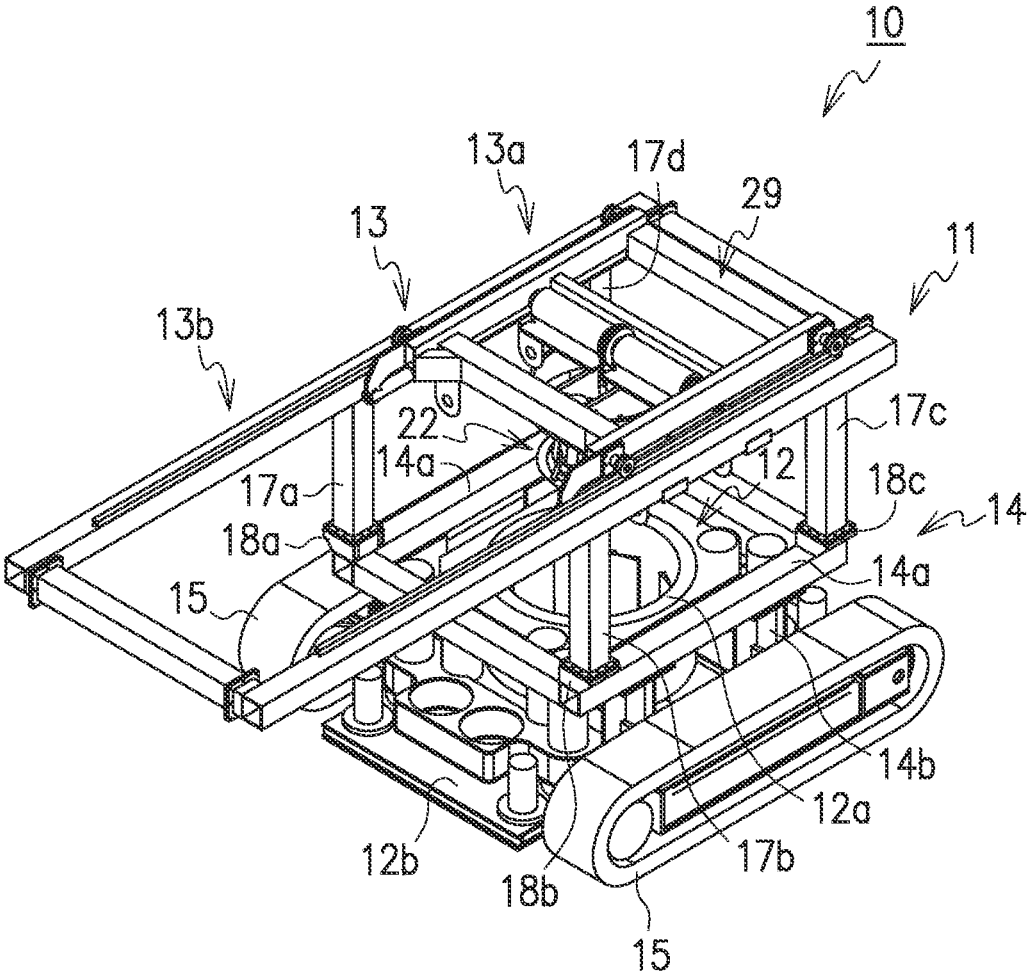
FIG. 1 is a perspective view of an excavation apparatus in which a mainframe has been rotated to a front direction of the excavation apparatus.

Embodiments of the subject matter will be described in more detail below with reference to the accompanying drawings. In the drawings, the same or corresponding component elements are identified using the same reference numerals, and redundant description will be omitted. In addition, some structures or parts of the drawings may be exaggerated in size in comparison with other structures or parts for the purpose of description, and therefore the drawings are not necessarily illustrated in reduced scales. Furthermore, some drawings are schematically illustrated to facilitate understanding of the structure illustrated therein.

An excavation apparatus 10 according to the present disclosure has a structure that facilitates excavation work in a low overhead clearance with a limitation in the overhead space, and includes a base unit 14; and a mainframe 11, which is disposed above the base unit 14 so as to be rotatable toward a predetermined position, as illustrated in FIGS. 1 to 4. The base unit 14 includes a tubing unit 12, which forms a hole wall in the ground by use of a casing tube 19; a base frame 14*a*, which has pedestals 18*a* to 18*d* to which columns 17*a* to 17*d* of the mainframe 11 are detachably coupled above the tubing unit 12; a support frame 14*b*, which supports the base frame 14*a*; and a pair of crawlers 15, which are attached to the support frame 14*b* so as to cause the excavation apparatus 10 to travel.

The tubing unit 12 has: a clamp function for clamping the casing tube 19; a push-in function for pushing the casing tube 19, which has been clamped, into the ground; a pull-out function for pulling out the casing tube 19, which has been pushed, from the ground; and a rotary function for rotating the casing tube 19 clockwise/counterclockwise with a push-in direction/a pull-out direction as the center of rotation.

The mainframe 11 is integrally formed of a horizontal frame 13 to be described later and a plurality of (four) columns 17*a* to 17*d* for supporting the horizontal frame 13 above the base frame 14*a*. The four columns 17*a* to 17*d* are detachably secured onto the respective four pedestals 18*a* to 18*d*, which are provided on the base frame 14*a*.

Above the tubing unit 12, the horizontal frame 13 has a slide base 29 for horizontally moving a casing tube 19, a hammer grab 22, or the like. The horizontal frame 13 is made up of a main part 13*a*, which is supported by upper end portions of the four columns 17*a* to 17*d*, and an overhang part 13*b*, which extends in the horizontal direction from the two columns 17*a* and 17*b*, and which overhangs outward from above the base frame 14*a*. The overhang part 13*b* is provided so that the slide base 29 is retreated from above the tubing unit 12 so as to attach the casing tube 19, the hammer grab 22, or the like, or so that the soil that has been excavated by the hammer grab 22 is discharged at a predetermined location. The slide base 29 horizontally reciprocates between the main part 13*a* and the overhang part 13*b* of the horizontal frame 13 while suspending the casing tube 19 or the hammer grab 22. It is to be noted that a driving mechanism by a well-known motor, hydraulic pressure, or the like is used for a moving mechanism of the slide base 29, a suspending lift mechanism for the hammer grab 22, the casing tube 19, or the like, and a traveling mechanism by the pair of crawlers 15, and thus its detailed description will be omitted.

Figure 2:
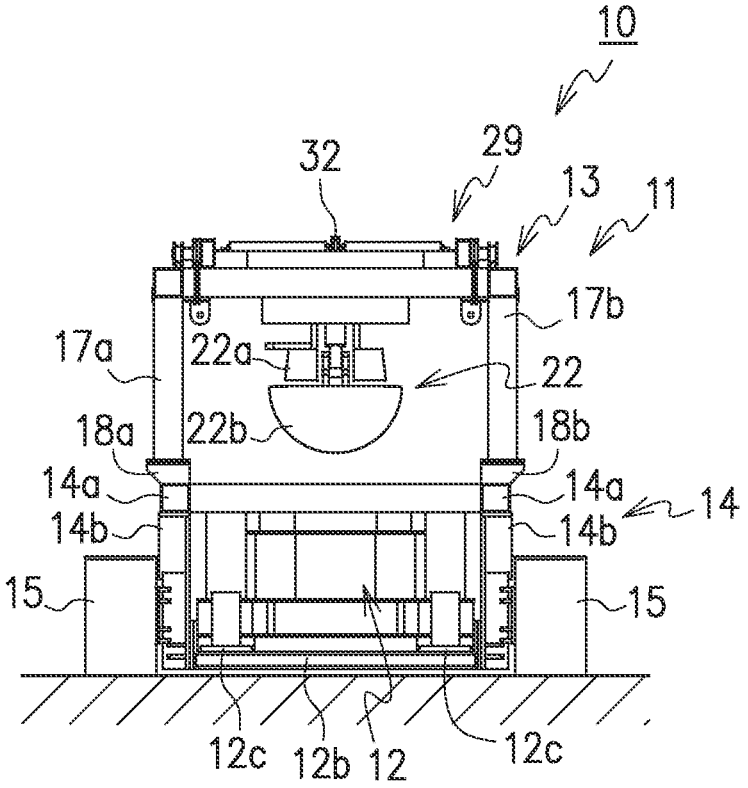
FIG. 2 is a front view of the excavation apparatus of FIG. 1.
Figure 3:
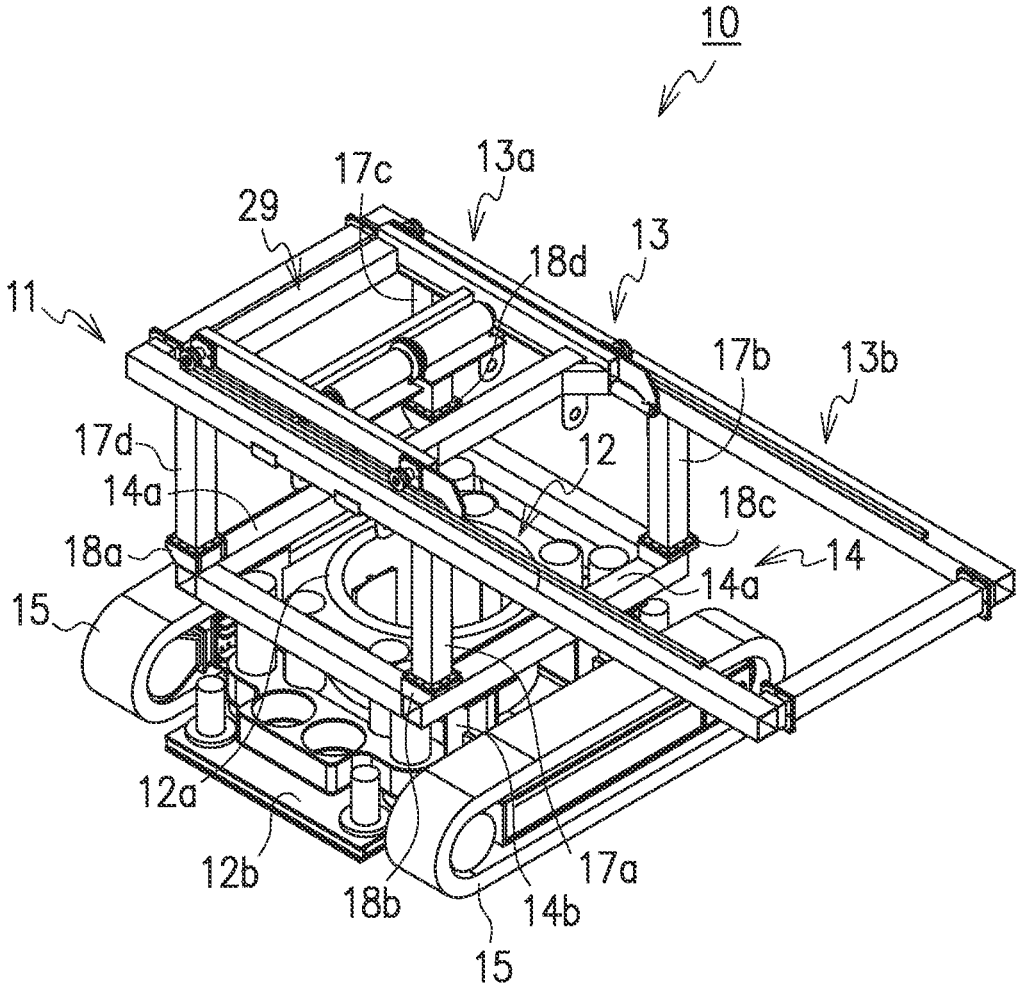
FIG. 3 is a perspective view of the excavation apparatus in which the mainframe has been rotated to a side surface direction of the excavation apparatus.

FIGS. 1 and 2 each illustrate a mode in which the mainframe 11 has been rotated so that the overhang part 13*b* of the horizontal frame 13 faces the traveling direction (front direction) of the crawlers 15. FIG. 3 illustrates a mode in which the mainframe 11 has been rotated counterclockwise by 90 degrees, and the overhang part 13*b* is positioned in a direction orthogonal to the traveling direction (side surface direction) of the crawlers 15.

Figure 4:
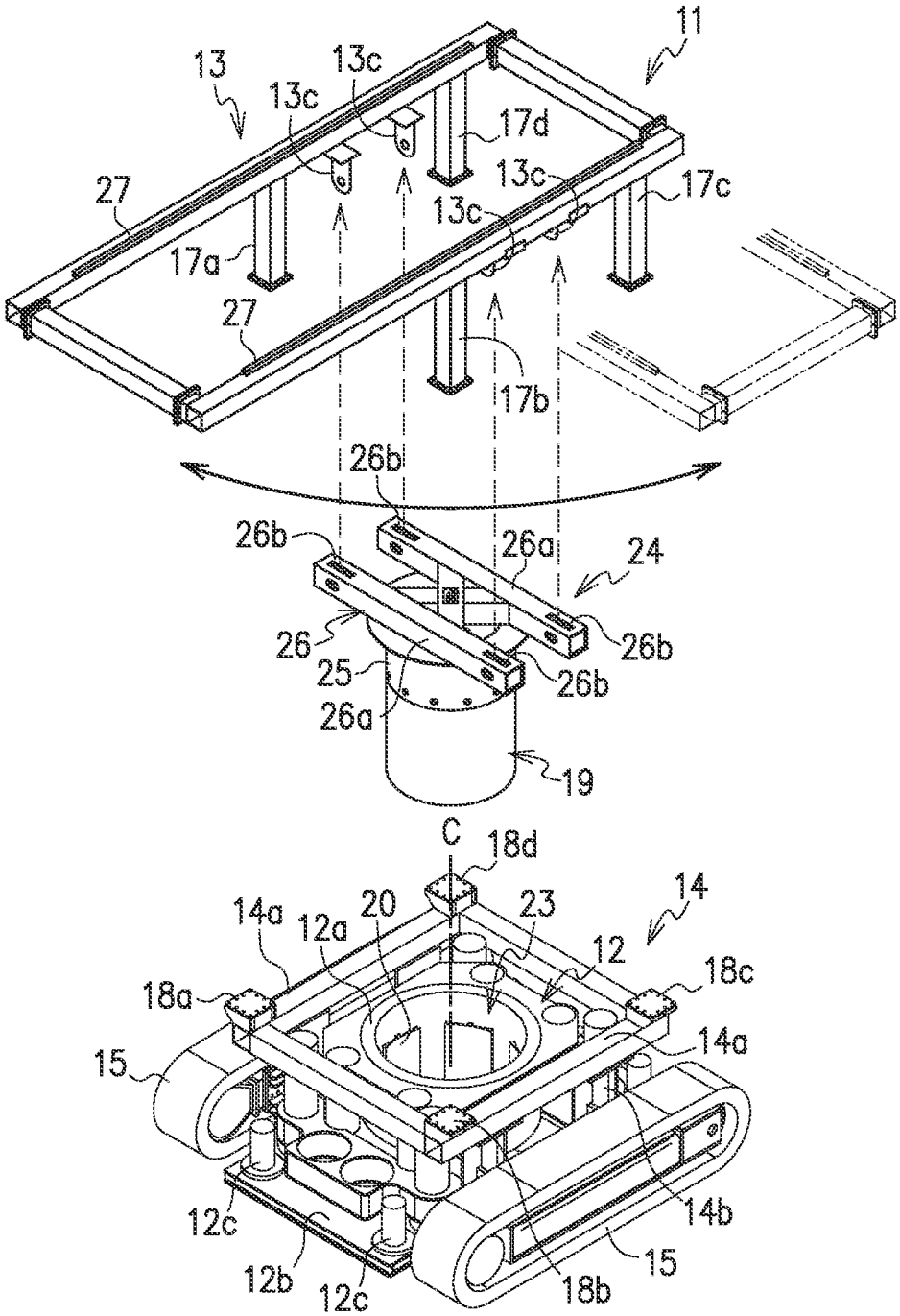
FIG. 4 is an exploded perspective view illustrating a rotation mechanism of the mainframe.

FIG. 4 illustrates an exploded view of a mechanism for rotating the mainframe 11 from the front direction toward the side surface direction. After the columns 17*a* to 17*d* are detached from the pedestals 18*a* to 18*d* on the base frame 14*a*, an operation for rotating the mainframe 11 is performed by use of the casing tube 19, which is to be arranged in the tubing unit 12, and a rotation assist jig 24, which is coupled to an upper portion of the casing tube 19. The rotation is driven by use of a clamp function of the tubing unit 12, in which the casing tube 19 and the rotation assist jig 24 are integrated, the push-in and pull-out functions, and the rotary function for rotating clockwise/counterclockwise with a central axis C in the push-in/pull-out direction as the center. In the mainframe 11, which has been rotated to a predetermined position, the pedestals 18*a* to 18*d* of the base frame 14*a* are coupled by corresponding columns 17*a* to 17*d*, which have been rotated. Details of the rotation mechanism of the mainframe 11 will be described later.

A controller (not illustrated) for driving the pair of crawlers 15 is provided in the base unit 14. The actions of the pair of crawlers 15, such as a forward movement, a backward movement, and a rotation in a left-right direction, and a speed adjustment are enabled by a remote operation from the controller at a remote location. In the remote operation, it is possible to use wired or wireless communication.

Four support legs 12*c*, which stably support the entire excavation apparatus 10 with respect to the ground, are provided at four corners of a bottom 12*b* of the tubing unit 12 so as to be capable of extending and contracting (FIG. 4 illustrates a state in which the support legs 12*c* are accommodated). The support legs 12*c* provided at four positions are accommodated in the tubing unit 12, while the excavation apparatus 10 is traveling on the crawlers 15. In the rotating operation of the mainframe 11 or in the excavation work, the four support legs 12*c* are made to extend downward from the bottom 12*b* and to be brought into contact with the ground so as to support the excavation apparatus 10 to maintain an equilibrium state with respect to the ground.

As illustrated in FIG. 4, the base frame 14*a* is provided with the pedestals 18*a* to 18*d*, to which the four columns 17*a* to 17*d* of the mainframe 11 are coupled. The four columns 17*a* to 17*d* of the mainframe 11 are arranged in a rotationally symmetric shape with the tubing unit 12 as the center. In addition, the four pedestals 18*a* to 18*d* of the base frame 14*a* are also arranged in a rotationally symmetric shape so as to respectively correspond to the four columns 17*a* to 17*d*. This configuration enables a change in the orientation of the mainframe 11 horizontally by 90 degrees with respect to the base unit 14. In this manner, after the orientation of the mainframe 11 is changed, the pedestals 18*a* to 18*d* and the columns 17*a* to 17*d* are respectively secured to each other via bolts or the like.

The tubing unit 12 is provided with a rotary part 12*a*, which has a cylindrical shape with a hollow 23, through which the hammer grab 22 is inserted. In addition, a clamp member 20, which clamps the outer circumferential surface of the casing tube 19, is provided on the inner circumferential surface of the rotary part 12*a*.

The horizontal frame 13 of the mainframe 11 has: a pair of guide rails 27, which extend in parallel with each other; and the slide base 29, which horizontally moves between the pair of guide rails 27. Guide grooves (not illustrated), along which the slide base 29 is placed to be horizontally movable, are respectively formed on the inner side surfaces, facing each other, of the pair of guide rails 27.

The slide base 29 is provided with a pulley 32, which suspends the casing tube 19 and the rotation assist jig 24 illustrated in FIG. 4 or the hammer grab 22 illustrated in FIG. 2, via a wire (not illustrated). The pulley 32 is operated for winding up through a winch (not illustrated) provided at an end portion of the overhang part 13*b* of the horizontal frame 13.

The hammer grab 22 is used for deep hole excavation or root cutting in building foundation, and has: a case 22*a*; and a pair of shells 22*b*, which are provided to be openable or closable at the tip of the case 22*a*, as illustrated in FIG. 2. A mechanism (not illustrated) for opening and closing the shells 22*b* through a wind-up operation of the wire via the pulley 32 is incorporated into the case 22*a*.

The rotation mechanism of the mainframe 11 illustrated in FIG. 4 is made up of the tubing unit 12, the casing tube 19, which is to be arranged in the tubing unit 12, and the rotation assist jig 24, which is interposed between the casing tube 19 and the horizontal frame 13. In assembling the rotation mechanism, the casing tube 19 is suspended on the slide base 29 (see FIGS. 1 to 3), is made to slide by the movement of the horizontal slide of the slide base 29 so as to be transferred above the tubing unit 12, and is lifted down into the rotary part 12*a*. Then the outside surface of the casing tube 19 is clamped to the tubing unit 12 by use of the clamp member 20, and the casing tube 19 is removed. Then, the rotation assist jig 24 is suspended from the slide base 29, is transferred to above the casing tube 19, which is clamped inside the tubing unit 12, and the rotation assist jig 24 is coupled to the upper portion of the casing tube 19.

Figure 5:
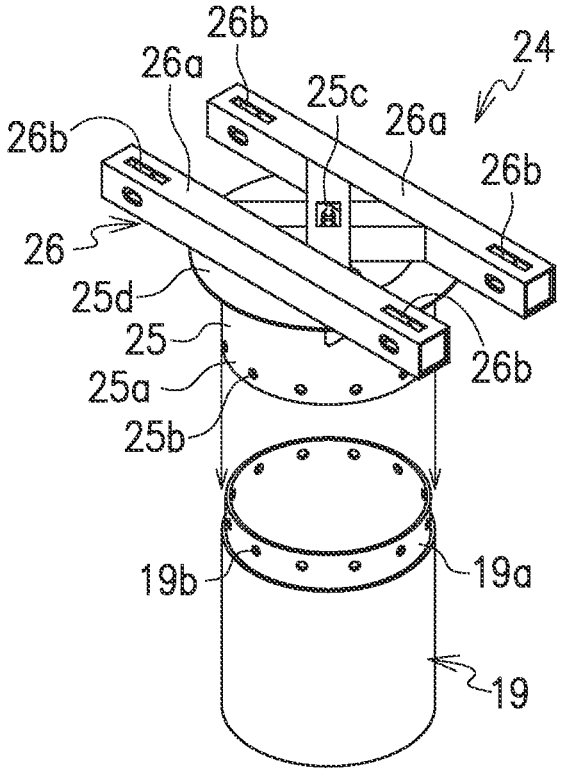
FIG. 5 is a perspective view of a casing tube and a rotation assist jig.

FIG. 5 illustrates a coupling structure between the casing tube 19 and the rotation assist jig 24. The rotation assist jig 24 is integrally formed of: a first coupling part 25, which has a cylindrical shape, and which is coupled to an end portion of the casing tube 19; and a second coupling part 26, which has an arm shape, and which protrudes horizontally from the top of the first coupling part 25. The first coupling part 25 is made up of a cylindrical body having the same diameter as that of the casing tube 19, and is formed of: an outer circumferential surface 25*a*, which is engaged along a connection surface 19*a* provided at the end portion of the casing tube 19; and a top plate 25*d*, which covers an upper portion of the outer circumferential surface 25*a*. An insertion opening 25*c*, through which a suspension tool (not illustrated) for suspending the rotation assist jig 24 on the slide base 29 (see FIGS. 1 to 3) is inserted, is provided at a central portion of the top plate 25*d*. A plurality of connection openings 19*b* for coupling and securing the casing tubes with each other are provided on the connection surface 19*a* of the casing tube 19. A plurality of connection openings 25*b* are also provided on the outer circumferential surface 25*a* of the first coupling part 25 so as to respectively correspond to the plurality of connection openings 19*b*.

The first coupling part 25 can be formed by processing another casing tube having the same shape as the casing tube 19 to a predetermined length. After the first coupling part and the casing tube 19 are engaged with each other such that the outer circumferential surface 25*a* of the first coupling part 25 covers the connection surface 19*a* of the casing tube 19, the plurality of connection openings 19*b* provided on the connection surface 19*a* of the casing tube 19 and the plurality of connection openings 25*b* provided on the first coupling part 25 are respectively secured with each other via bolts. It is to be noted that it is sufficient if at least two positions facing each other are secured by the bolts so that the first coupling part 25 does not easily come off from the casing tube 19.

The second coupling part 26 is made up of a pair of arms 26*a*, which extend in parallel with each other interposing the insertion opening 25*c*, which is positioned at the central portion of the top plate 25*d* of the first coupling part 25. Both end portions of the pair of arms 26*a* protrude outward from the first coupling part 25, and engagement grooves 26*b* to be coupled with the horizontal frame 13 are provided at four positions on both end portions of the pair of arms 26*a*. It is to be noted that the first coupling part 25 and the second coupling part 26, which constitute the rotation assist jig 24, are merely examples, and are not limited to the above-described shapes. The shapes may be any ones as long as the casing tube 19 and the horizontal frame 13 can be coupled reliably and stably.

Figure 8:
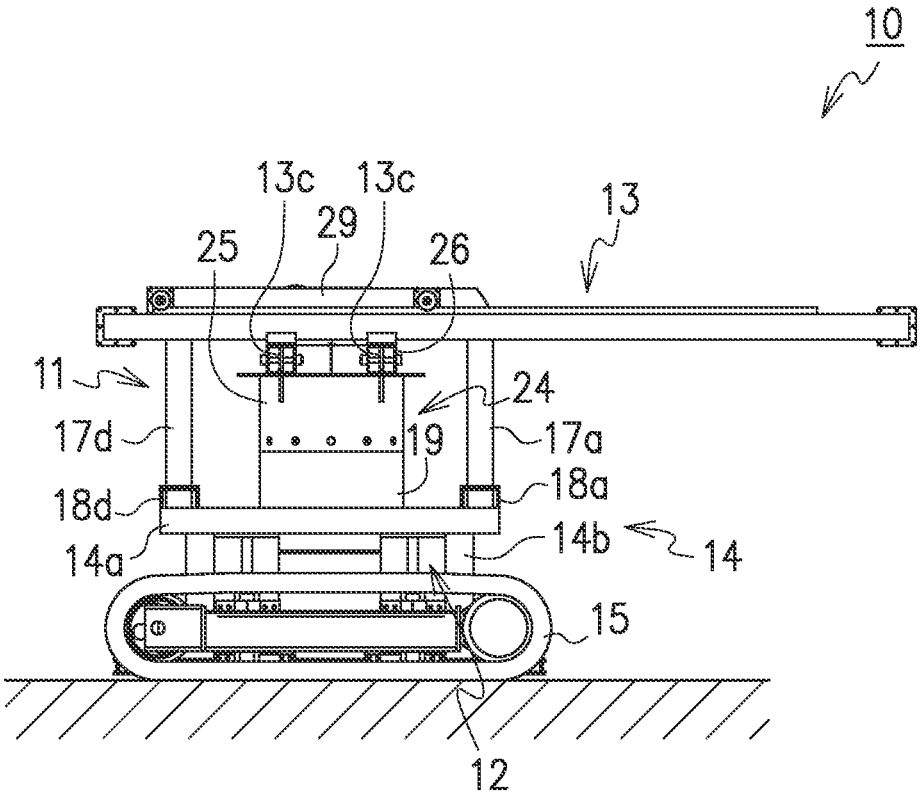
FIG. 8 is a side view illustrating a state in which the rotation assist jig is coupled to the casing tube and the horizontal frame.

As illustrated in FIG. 4, the rotation assist jig 24 and the horizontal frame 13 are coupled with each other by respectively engaging the engagement grooves 26*b* at four positions provided in the pair of arms 26*a* of the rotation assist jig 24 with engagement pieces 13*c* at four positions provided on the lower side of the pair of guide rails 27, and securing together via the bolts (see FIG. 8). In this manner, the casing tube 19 and the mainframe 11 are coupled with each other through the rotation assist jig 24. The mainframe 11, which has been detached from the top of the base frame 14*a*, is enabled to rotate to a predetermined position by use of the above-described respective functions of the tubing unit 12, in which the casing tube 19 is arranged.

The mainframe 11, which has been rotated by the above rotation mechanism from the front position illustrated in FIG. 1 to the side surface position illustrated in FIG. 3, is coupled in a state such that the column 17*a* is coupled to the pedestal 18*b*, the column 17*b* is coupled to the pedestal 18*c*, the column 17*c* is coupled to the pedestal 18*d*, and the column 17*d* is coupled to the pedestal 18*a*. In this manner, the corresponding positions of the columns 17*a* to 17*d* and the pedestals 18*a* to 18*d* are changed in accordance with the rotation of the mainframe 11 in the unit of 90 degrees.

Figure 6:
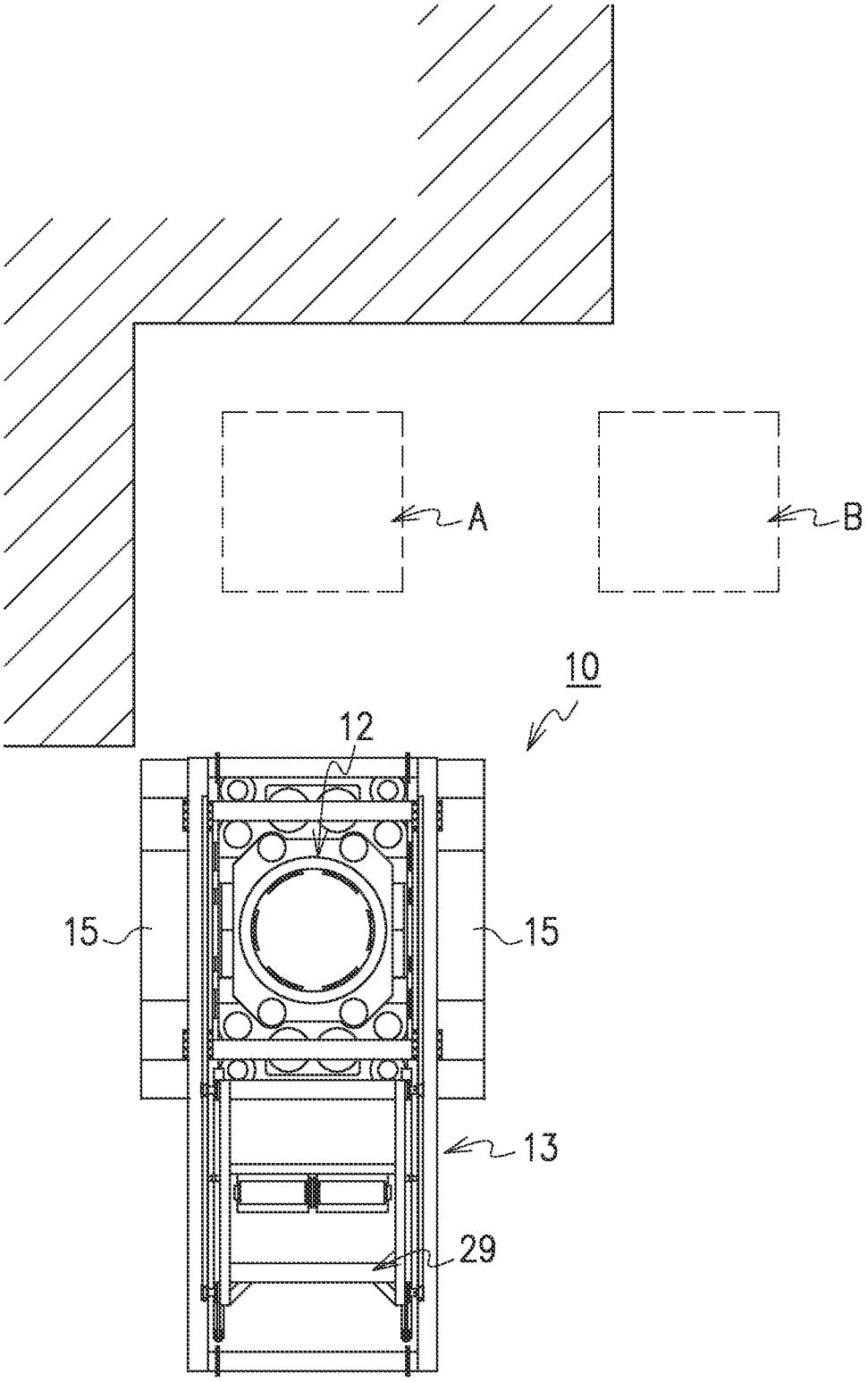
FIG. 6 is a plan view of the excavation apparatus that moves to an excavation area.

Next, a method for rotating the mainframe 11 will be described, based on FIGS. 6 to 10. In the present embodiment, as illustrated in FIG. 6, a corner section partitioned in a letter L shape by a building or the like is set as an excavation area A, and a space in a right direction of the excavation area A in the drawing is set as a discharge area B. In addition, the casing tube 19 is assumed to have been transferred and arranged beforehand in the tubing unit 12.

(1) The crawlers 15 are driven to move the excavation apparatus 10 in the mode illustrated in FIGS. 1 and 2 to a predetermined position before moving toward the excavation area A (FIG. 6). After the movement, as illustrated in FIG. 2, the support legs 12*c* at four positions provided in the tubing unit 12 are extended from the bottom 12*b* of the tubing unit 12 and brought into contact with the ground, so that the excavation apparatus 10 is in an equilibrium state.

Figure 7:
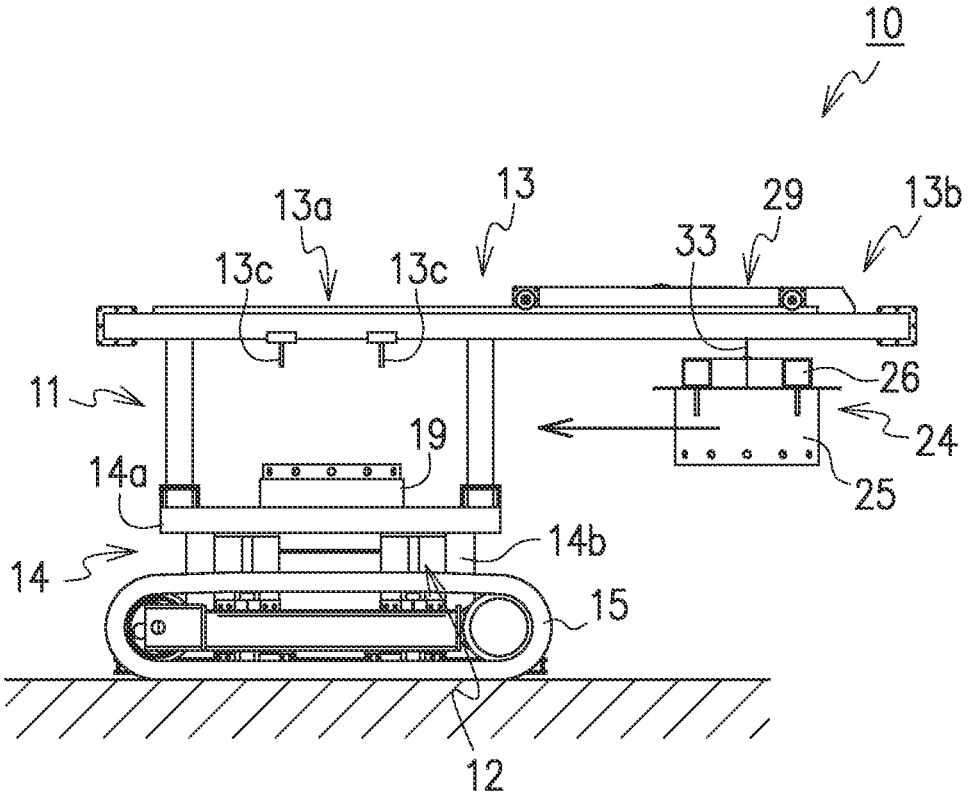
FIG. 7 is a side view illustrating a state in which the rotation assist jig is moved to above the casing tube.

(2) After moving the slide base 29 to the overhang part 13*b* of the horizontal frame 13, the rotation assist jig 24 is suspended on the slide base 29 via a wire 33, and the rotation assist jig 24 is moved toward above the casing tube 19 arranged in the tubing unit 12 (FIG. 7).

(3) As illustrated in FIG. 5, the first coupling part 25 of the rotation assist jig 24 is coupled to the casing tube 19, and the engagement pieces 13*c* provided on the horizontal frame 13 are respectively engaged and coupled with the engagement grooves 26*b* provided in the second coupling part 26 of the rotation assist jig 24 (FIG. 8).

Figure 9:
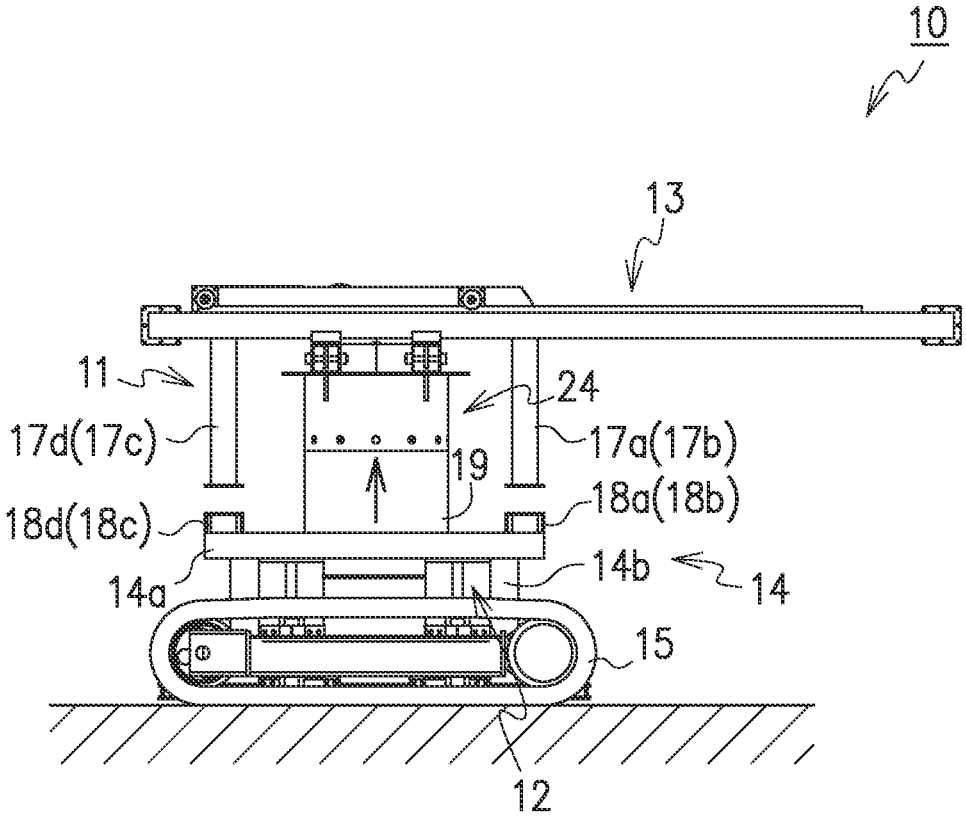
FIG. 9 is a side view illustrating a state in which the mainframe rotates to the side surface direction of the excavation apparatus.

(4) After decoupling the pedestals 18*a* to 18*d* of the base frame 14*a* and the columns 17*a* to 17*d* of the mainframe 11, the mainframe 11 is lifted up by use of the pull-out function of the tubing unit 12, the rotary part 12*a* is also driven, and the entire mainframe 11, which is integrated with the casing tube 19 and the rotation assist jig 24 above the base frame 14*a*, is driven for rotation (FIG. 9).

Figure 10:
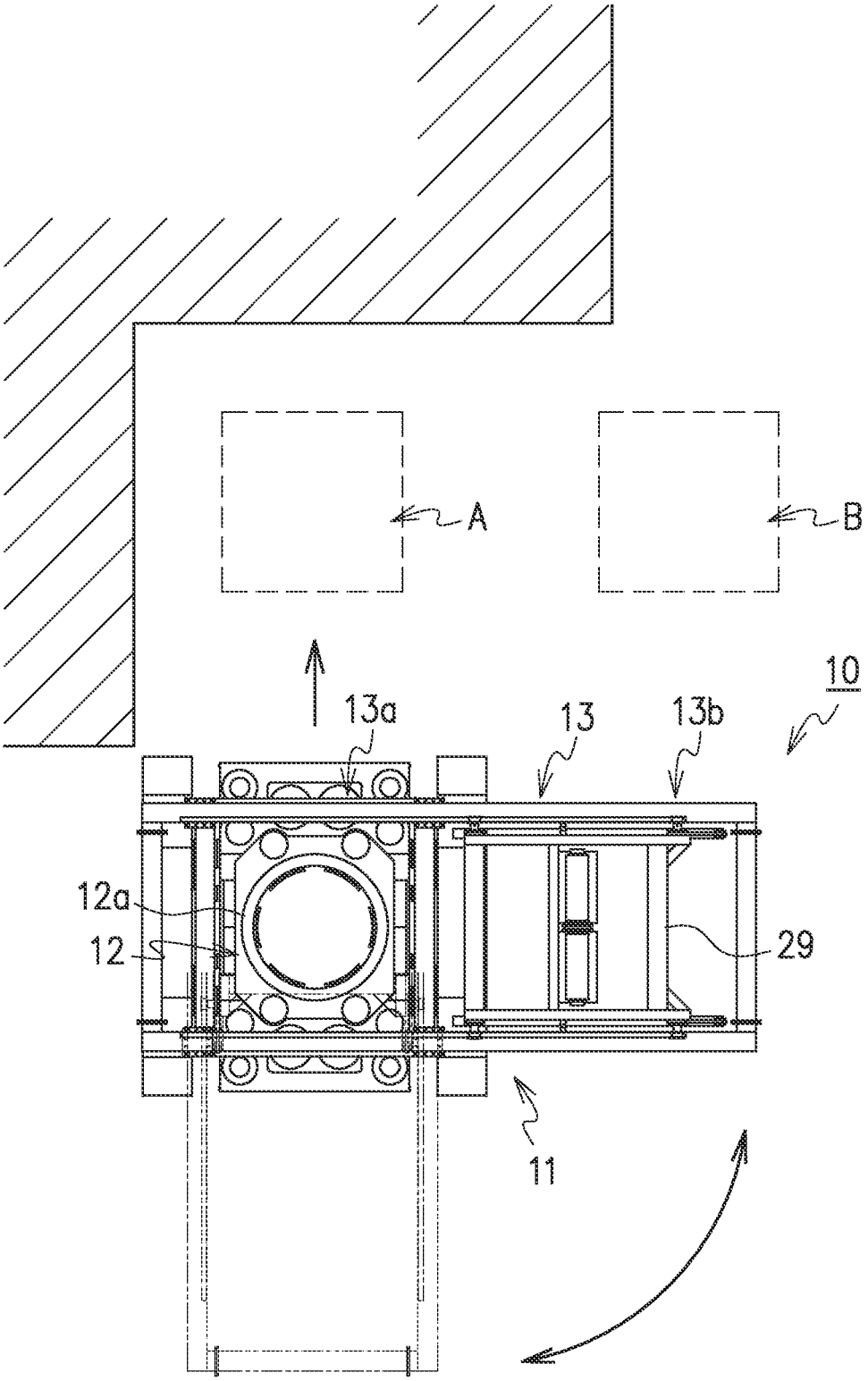
FIG. 10 is a plan view illustrating a rotating state of the mainframe.

(5) As illustrated in FIG. 10, the mainframe 11 is rotated horizontally to a right side surface position corresponding to the rotation counterclockwise by 90 degrees, and then as illustrated in FIG. 3, the corresponding columns 17*a* to 17*d* and the pedestals 18*a* to 18*d* on the base frame 14*a* are made to face each other. At this position, after the mainframe 11 is lifted down by use of the push-in function of the tubing unit 12, the columns 17*a* to 17*d* and the pedestals 18*a* to 18*d* are fastened together again by the bolts.

After the rotating operation of the mainframe 11 is completed by the above processes (1) to (5), the rotation assist jig 24 is decoupled from the horizontal frame 13 and the casing tube 19. Then, the slide base 29, from which the rotation assist jig 24 is suspended, is moved toward the overhang part 13*b* of the horizontal frame 13, and the rotation assist jig 24 is detached. Furthermore, the casing tube 19 arranged in the tubing unit 12 is suspended on the slide base 29 via the wire, and is moved to the overhang part 13*b* of the horizontal frame 13 and detached in the same manner as described above.

Figure 11:
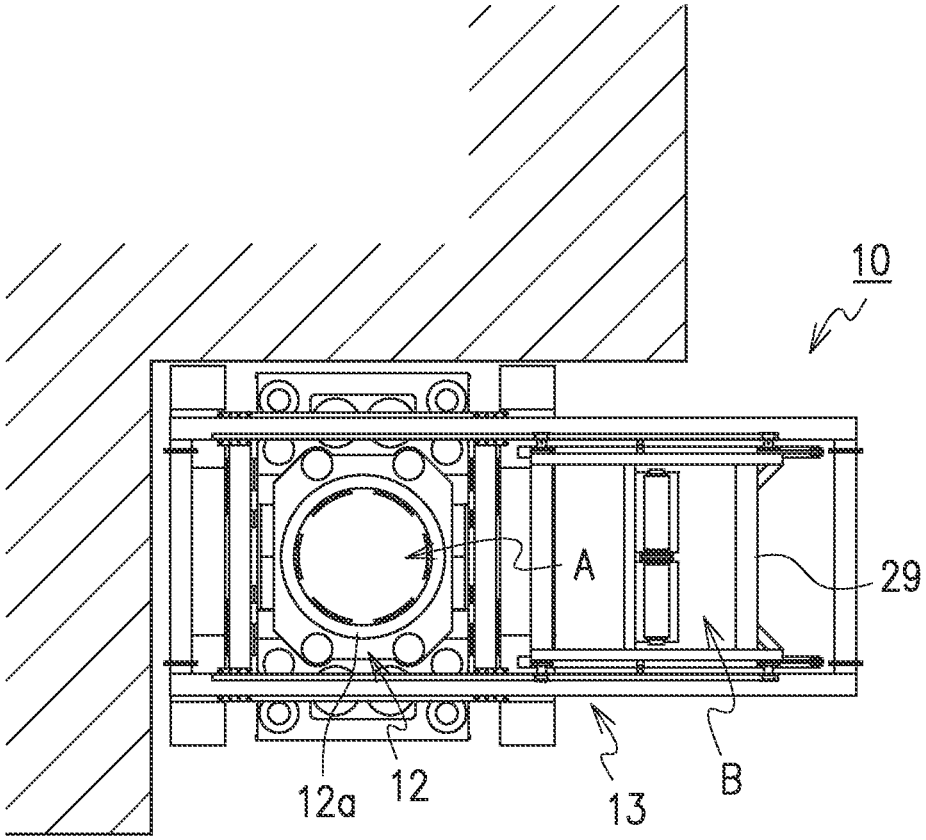
FIG. 11 is a plan view illustrating a state in which the excavation apparatus, in which the mainframe has been rotated, has been moved to the excavation area.
Figure 12:
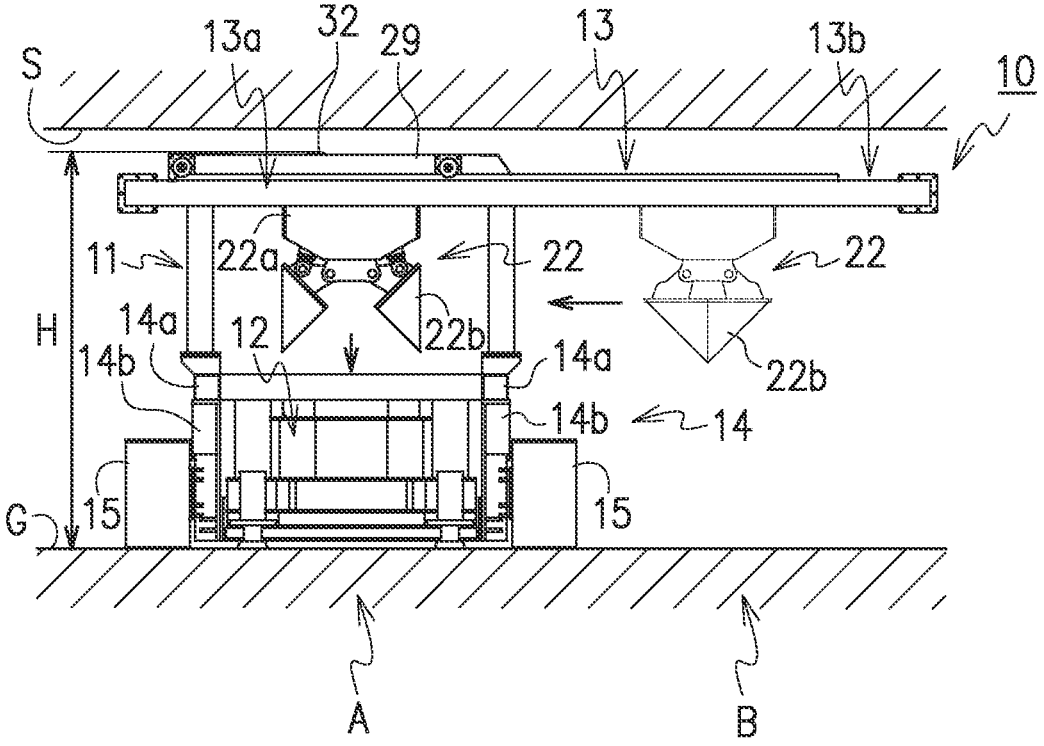
FIG. 12 is a side view illustrating a state in which a hammer grab is moved to the excavation area.

Next, an excavation process and a discharge process by the hammer grab 22 will be described with reference to FIGS. 11 to 13. As illustrated in FIG. 11, the excavation apparatus 10, in which the mainframe 11 has been rotated by 90 degrees, is moved to the excavation area A. Then, as illustrated in FIG. 12, the hammer grab 22 is made to slide by the slide base 29 to move to above the tubing unit 12, and is lifted down from this height position into the rotary part 12*a*. The shells 22*b* are lifted down in an open state, and is plunged into the ground directly. By winding up the wire suspending the hammer grab 22 from this state by use of a winch (not illustrated) provided on the horizontal frame 13, the shells 22*b* are closed holding excavated materials such as soil and rocks.

Figure 13:
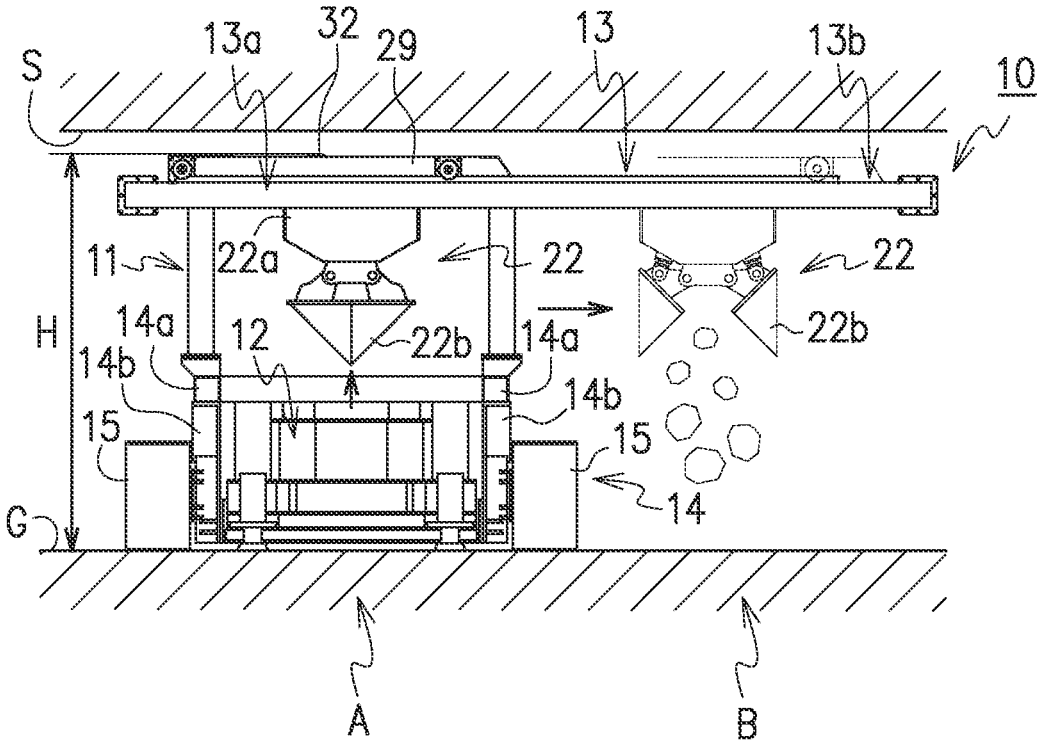
FIG. 13 is a side view illustrating a state in which the hammer grab is moved to the excavation area.

Then, as illustrated in FIG. 13, the hammer grab 22 is pulled up from the ground with the shells 22*b* closed, and is further pulled up to above the tubing unit 12. Subsequently, the slide base 29, on which the hammer grab 22 is suspended, is moved toward the overhang part 13*b* of the horizontal frame 13. Then, in the discharge area B, the shells 22*b* are opened to enable discharging of the excavated materials such as excavated soil and rocks. By repeating such operations to cause the hammer grab 22 to reciprocate horizontally by use of the slide base 29 from the excavation area A to the discharge area B, the excavation work and the discharge work in a place with a limitation in the overhead space can be easily and efficiently conducted.

As illustrated in FIGS. 12 and 13, in a work space with a height limitation from a ground surface G to a ceiling surface S, the excavation apparatus 10 in the present embodiment has a configuration of being self-propelled in a state suited for a low overhead clearance toward the target excavation area A. The horizontal frame 13 is capable of suspending and supporting the hammer grab 22 at a lowest position. In the excavation apparatus 10 with such a configuration, the horizontal frame 13 is supported above the base unit 14 by the columns 17*a* to 17*d*, which have substantially the same height as that of the hammer grab 22, thereby enabling suppression of a height H to an upper end of the pulley 32 from the ground surface G as the basis. This enables the excavation apparatus 10 easily to enter a building with a roof, a tunnel, or the like, and to conduct the excavation work on such a spot.

As described heretofore, according to the mainframe rotation mechanism and the mainframe rotation method for the excavation apparatus disclosed in the present application, the mainframe rotates horizontally with respect to the ground. This eliminates the need for increasing the height of the excavation apparatus, thereby enabling adaptability to the work environment with a limitation in the overhead space, and enabling easily changing the mainframe that transports and supports the hammer grab to a predetermined position by use of the respective functions of the tubing unit provided in the excavation apparatus. Thus, the excavation work and the discharge work can be conducted easily and efficiently even in a location where an entrance passage is narrow for the excavation apparatus and a direction change is difficult. The excavation apparatus in the present embodiment is suited for a low overhead clearance, and its configuration including the rotation mechanism of the mainframe is simple and compact in order to be adapted to the excavation site where the work space is limited in a height direction and a plane direction. Therefore, the excavation apparatus is useful not only for the work in a narrow and low overhead clearance but also in any work environment.

What is claimed is:

1. A mainframe rotation mechanism of an excavation apparatus, the excavation apparatus comprising:

a tubing unit configured to form a hole wall in the ground with a casing tube;

a base frame disposed with the tubing unit as a center; and a mainframe including a horizontal frame and a plurality of columns, the horizontal frame including a slide base for horizontally moving a hammer grab above the tubing unit, the plurality of columns supporting the horizontal frame above the base frame, wherein the plurality of columns are arranged detachably from the base frame, and the casing tube to be arranged in the tubing unit and the horizontal frame are coupled with each other through a rotation assist jig, and wherein the casing tube is rotated with the plurality of columns being detached from the base frame, the horizontal frame and the plurality of columns are rotated together with the rotation assist jig to a predetermined position, and the plurality of columns are secured onto the base frame at that position.

2. The mainframe rotation mechanism of the excavation apparatus according to claim 1, wherein the rotation assist jig between the casing tube and the horizontal frame includes a first coupling part to be coupled to the casing tube and a second coupling part to be coupled to the horizontal frame.

3. The mainframe rotation mechanism of the excavation apparatus according to claim 1, wherein the plurality of columns are disposed in a rotationally symmetric shape with the tubing unit as the center.

4. The mainframe rotation mechanism of the excavation apparatus according to claim 1, wherein the casing tube rotates in accordance with rotation of the tubing unit that has been driven.

5. A mainframe rotation method for an excavation apparatus, the excavation apparatus comprising:

a tubing unit configured to form a hole wall in the ground with a casing tube;

a base frame disposed with the tubing unit as a center; and a mainframe including a horizontal frame and a plurality of columns, the horizontal frame including a slide base for horizontally moving a hammer grab above the tubing unit, the plurality of columns supporting the horizontal frame above the base frame, the mainframe rotation method comprising:

arranging a rotation assist jig between the casing tube to be arranged in the tubing unit and the horizontal frame;

coupling the rotation assist jig to the casing tube and the horizontal frame;

driving the tubing unit to rotate so as to rotate the casing tube after detaching the plurality of columns from the base frame; and after the horizontal frame and the plurality of columns are rotated together with the rotation assist jig to a predetermined position, securing the plurality of the columns onto the base frame at that position.

* * * * *